US009354002B2

(12) United States Patent
Vouche et al.

(10) Patent No.: US 9,354,002 B2
(45) Date of Patent: May 31, 2016

(54) AIR COOLED CONDENSER APPARATUS AND METHOD

(71) Applicants: Michel Vouche, Brussels (BE); Fabien Fauconnier, Le Roeulx (BE)

(72) Inventors: Michel Vouche, Brussels (BE); Fabien Fauconnier, Le Roeulx (BE)

(73) Assignee: SPX Cooling Technologies, Inc., Overland Park, KS (US)

( * ) Notice: Subject to any disclaimer, the term of this patent is extended or adjusted under 35 U.S.C. 154(b) by 539 days.

(21) Appl. No.: 13/788,349

(22) Filed: Mar. 7, 2013

(65) Prior Publication Data

US 2014/0251589 A1 Sep. 11, 2014

(51) Int. Cl.
*F28F 27/02* (2006.01)
*F28B 1/06* (2006.01)

(52) U.S. Cl.
CPC .. *F28F 27/02* (2013.01); *F28B 1/06* (2013.01)

(58) Field of Classification Search
CPC ..... F28F 27/02; F28B 1/06; F28B 7/00; F28B 9/00; F28B 9/02; F28B 9/08; F28B 11/00; F28B 2001/065; F01K 9/00; F01K 9/003; F01K 9/006
USPC ..... 165/281, 286
See application file for complete search history.

(56) References Cited

U.S. PATENT DOCUMENTS

| | | | | | |
|---|---|---|---|---|---|
| 3,289,742 | A * | 12/1966 | Niemann | 165/111 |
| 3,612,172 | A * | 10/1971 | Dohnt | 165/111 |
| 3,660,980 | A * | 5/1972 | Knirsch et al. | 60/686 |
| 5,548,958 | A * | 8/1996 | Lewis | 60/693 |
| 2009/0220334 | A1 * | 9/2009 | Vouche | 415/119 |
| 2013/0292103 | A1 * | 11/2013 | Eindhoven | F28B 1/06 165/173 |
| 2013/0333349 | A1 * | 12/2013 | de Lausnay | F01K 7/00 60/39.182 |
| 2014/0150989 | A1 * | 6/2014 | Eindhoven | F28F 9/007 165/67 |
| 2015/0330709 | A1 * | 11/2015 | Vouche | F28B 1/06 202/185.3 |
| 2015/0345166 | A1 * | 12/2015 | Quickelberghe | E04H 5/12 165/68 |

* cited by examiner

*Primary Examiner* — Ljiljana Ciric
(74) *Attorney, Agent, or Firm* — Baker & Hostetler LLP

(57) ABSTRACT

An air cooled condenser (ACC) system is described having a first street having at least one air cooled condenser module and a second street having at least one air cooled condenser module. The system employs a steam inlet conduit provides steam to the first and second streets. The air cooled condenser system has a standard vacuum system for providing suction pressure to the first and second street. The air cooled condenser system also has an auxiliary vacuum system that provides suction pressure to the first and second streets.

18 Claims, 4 Drawing Sheets

AIR COOLED CONDENSER APPARATUS AND METHOD

FIELD OF THE INVENTION

The present invention relates generally to an air cooled condenser (ACC) utilized in a power plant facility or the like. More particularly, the present invention relates to an air cooled condenser system design and method that limits or reduces the backpressure peak that may occur during the start-up procedure of the power plant or steam process.

BACKGROUND OF THE INVENTION

In steam generating systems such as various industrial processes or plants, for example, power plants, an air cooled condenser is employed downstream of a steam turbine to convert steam, after it has passed through the steam turbine, from its gaseous state to its liquid state. One of the most wide spread dry cooling systems employed is the direct dry cooling. In this cooling method, if it serves power plant cycles, the water vapor, expands in a steam turbine, exits from the turbine through a steam pipe with a large diameter, then through an upper distribution chamber where it enters a steam-air heat exchanger such as an air cooled condenser.

During operation, the steam flows into the condenser. As previously mentioned, the condenser may be air-cooled and comprises a steam inlet duct, a plurality of condenser tubes, and a condensate outlet duct. Steam passes into the condenser through the steam inlet duct and flows through the condenser tubes. Air is forced over outer surfaces of the tubes so as to cool the tubes and, hence, the steam flowing through the tubes, thus causing the steam to be converted into a liquid condensate. The condensate can be reused in generating steam for the steam turbine such that at least a portion of it later returns to the condenser where it is once again is converted to its liquid state in the condenser.

During the start-up operation of a power plant or the like, steam is slowly introduced into the air cooled condenser (ACC) due to the start up "behavior" of the boiler used in such systems. It is desirable to avoid backpressure peaks in order to have safe operation of the steam turbine. Due to the large volume of air trapped in the air cooled condenser (ACC) system prior to start up, a pressure peak can occur due to the compression of the trapped air inside air cooled condenser (ACC). Typically, the volume of trapped gas is such that the backpressure peak normally happens when steam has not yet arrived at the exchange tubes, but upon initial start up procedures. Moreover, because the air cooled condenser pressure is typically below atmospheric pressure, it is not possible to employ a valve to vent to entire system while injecting steam therein during start up.

One solution to the aforementioned problem is to increase the air ejection equipment capacity which can more rapidly reduce the amount of air trapped in the air cooled condenser (ACC) which will in turn reduce the potential for a backpressure peak. Nevertheless, this solution can lead to drastic cost increase of as it may require significant capital investment as the air extraction equipment is expensive and has to be adapted to the air cooled condenser (ACC) configuration and process daring start up conditions.

Accordingly, it is desirable to provide a steam turbine system employing an air cooled condenser that is economical and safe during start-up procedures. More specifically, it is desirable to provide an air cooled condenser design and method of start up that isolates some of the volume of the trapped air in the air cooled condenser system that is economical and safe.

SUMMARY OF THE INVENTION

In one embodiment of the present invention, an air cooled condenser system is provided, comprising: a first street having at least one air cooled condenser module; a second street having at least one air cooled condenser module; a steam inlet conduit comprising a first feed inlet in fluid communication with said first street and a second feed inlet in fluid communication with said second street, wherein said steam inlet provides steam to said first and second streets; a first flow control valve positioned on said first inlet that controls the flow of steam to said first street; a second flow control valve positioned on said second inlet that controls the flow of steam to said second street; a first vacuum system for providing suction pressure to said first and second street, comprising: a suction conduit in connected to a pump; a first vacuum feed that extends from said suction conduit and is in fluid communication with said first street; a second vacuum feed that extends from said suction conduit and is in fluid communication with said second street; a first suction valve connected to said first vacuum feed that controls suction flow to said first street; and a second suction valve connected to said second vacuum feed that controls suction flow to said second street.

In another embodiment of the present invention, an air cooled condenser system is provided, comprising: a first street having at least one air cooled condenser module; a second street having at least one air cooled condenser module; a steam inlet conduit comprising a first feed inlet in fluid communication with said first street and a second feed inlet in fluid communication with said second street, wherein said steam inlet provides steam to said first and second streets; a first flow control valve positioned on said first inlet that controls the flow of steam to said first street; a second flow control valve positioned on said second inlet that controls the flow of steam to said second street; a first vacuum system for providing suction pressure to said first and second street, comprising: a suction conduit in connected to a pump; a first vacuum feed that extends from said suction conduit and is in fluid communication with said first street; a second vacuum feed that extends from said suction conduit and is in fluid communication with said second street; a first suction valve connected to said first vacuum feed that controls suction flow to said first street; a second suction valve connected to said second vacuum feed that controls suction flow to said second street; a second vacuum system for providing suction pressure to said first and second street, comprising: a second suction conduit in connected to a second, auxiliary pump; a third vacuum feed that extends from said suction conduit and is in fluid communication with said first street; a fourth vacuum feed that extends from said suction conduit and is in fluid communication with said second street; a third suction valve connected to said first vacuum feed that controls suction flow to said first street; and a fourth suction valve connected to said second vacuum feed that controls suction flow to said second street.

In yet another embodiment of the present invention, a start up method for an air cooled condenser system is provided, comprising: providing an air cooled condenser comprising: a first street having at least one air cooled condenser module; a second street having at least one air cooled condenser module; a steam inlet conduit comprising a first feed inlet in fluid communication with said first street and a second feed inlet in fluid communication with said second street, wherein said steam inlet provides steam to said first and second streets; a first flow control valve positioned on said first inlet that controls the flow of steam to said first street; a second flow control valve positioned on said second inlet that controls the flow of steam to said second street; a first vacuum system for providing suction pressure to said first and second street, comprising: a suction conduit in connected to a pump; a first vacuum feed that extends from said suction conduit and is in fluid communication with said first street; a second vacuum feed that extends from said suction conduit and is in fluid communication with said second street; first suction valve connected to said first vacuum feed that controls suction flow to said first street; and a second suction valve connected to said second vacuum feed that controls suction flow to said second street; actuating the first flow controlled valve to an open position that allows steam to flow to the at least one air cooled condenser disposed in the first street; actuating the second flow controlled valve to a closed position that prevents steam flow to the at least one air cooled condenser module disposed in the second street; actuating the first suction valve to a closed position; actuating the second suction valve to an open position; applying a suction pressure to the second street to draw down an internal pressure of the second street; and flowing steam through the first street.

In still another embodiment of the present invention, an air cooled condenser system is provided, comprising: means for providing an air cooled condenser comprising: a first street having at least one air cooled condenser module; a second street having at least one air cooled condenser module; a steam inlet conduit comprising a first feed inlet in fluid communication with said first street and a second feed inlet in fluid communication with said second street, wherein said steam inlet provides steam to said first and second streets; a first flow control valve positioned on said first inlet that controls the flow of steam to said first street; a second flow control valve positioned on said second inlet that controls the flow of steam to said second street; a first vacuum system for providing suction pressure to said first and second street, comprising: a suction conduit in connected to is pump; a first vacuum feed that extends from said suction conduit and is in fluid communication with said first street; a second vacuum feed that extends from said suction conduit and is in fluid communication with said second street; a first suction valve connected to said first vacuum feed that controls suction flow to said first street; and a second suction valve connected to said second vacuum feed that controls suction flow to said second street; means for actuating the first flow controlled valve to an open position that allows steam to flow to the at least one air cooled condenser disposed in the first street; means for actuating the second flow controlled valve to a closed position that prevents steam flow to the at least one air cooled condenser module disposed in the second street; means for actuating the first suction valve to a closed position; means for actuating the second suction valve to an open position; means for applying a suction pressure to the second street to draw down an internal pressure of the second street; and means for flowing steam through the first street.

In another embodiment of the present invention, an air cooled condenser system is provided, comprising: a first street having at least one air cooled condenser module; a second street having at least one air cooled condenser module; a first vacuum system for providing suction pressure to said first and second street; and a second vacuum system providing suction pressure to said first and second streets.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the nit will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
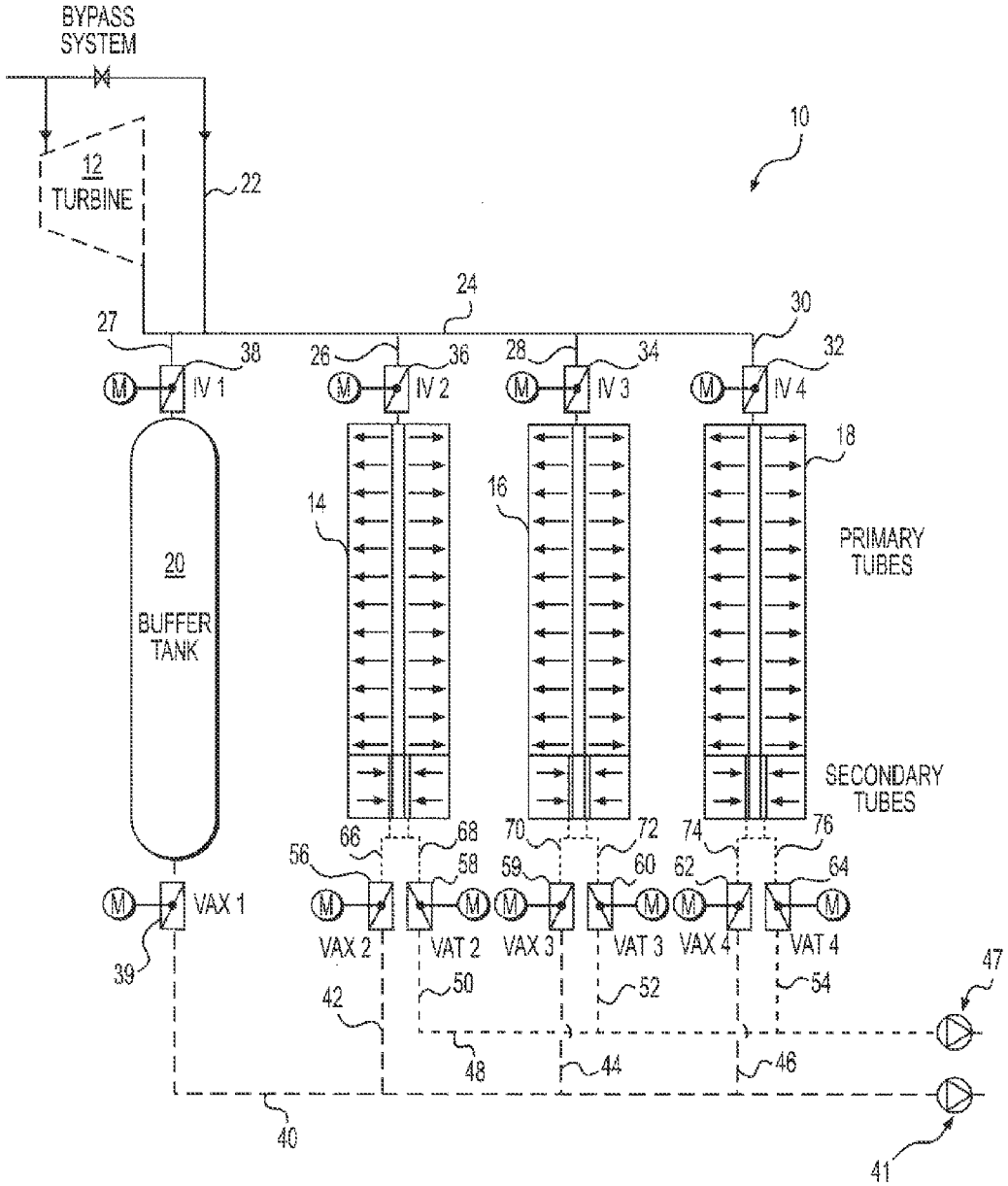
FIG. 1 is a schematic view of an air cooled condenser design connected to a steam generating system in accordance with an embodiment of the present invention.

An embodiment of the present inventive system for an air cooled condenser (ACC) utilized in a power plant facility or the like, generally designated 10 is provided. Turning specifically to FIG. 1, an air cooled condenser (ACC) system is illustrated connected to a turbine 12 of as part of an industrial process plant or the like. As depicted, the air cooled condenser (ACC) 10 includes first 14, second 16, and third 18 heat exchange terminals, commonly referred to as streets, that carry out heat exchange between the process steam and the atmospheric air, for example. Please note that while three (3) streets 14, 16, 18 are depicted, this exemplary only and more or less streets may be employed depending upon heat exchange needs and the industrial process involved. The streets 14, 16, and 18 have a number of air cooled condenser (ACC) modules that may vary from plant to plant depending upon the heat exchange capacity required. The the air cooled condenser (ACC) system 10 further includes a buffer tank 20 in fluid communication with each of the streets 14, 16 and 18 along while it is also in communication with the turbine 12.

The air cooled condenser (ACC) 10 system also includes a bypass conduit 22. As the name suggests, the bypass conduit 22 allows for the a portion, or all of the process steam to bypass the turbine 12 and enter the streets 14, 16, 18 of the the air cooled condenser (ACC) system 10. The bypass conduit 22 connects with each of the feed lines or feed conduits 26, 27, 28 and 30. As can be seen, feed line 26 provides steam to the first street 14, feed line 27 provides steam to the buffer tank 20, feed line 28 provides steam to the second street 16 and finally, feed line 30 provides steam to the third street 18.

As can be seen in FIG. 1, each of the feed lines or conduits is in fluid communication with a flow valve that controls the flow of steam into each respective street 14, 16 and 18. Specifically, the flow control valve 32 controls the flow of steam into the third street 18 whereas flow control valve 34 controls the flow of steam into street 16 and flow control valve 36 controls the flow of steam into the first street 14. Each of the respective flow valves 32, 34, 36 is operated by a controller that actuates said valves in response to pressure probes located in the duct 24.

Turning now to the vacuum systems 41 and 47 of the air cooled condenser (ACC) 10, an auxiliary vacuum system 41 is provided having an auxiliary vacuum conduit 40 is illustrated. The auxiliary vacuum conduit 40 is in fluid communication with each of the streets 14, 16, 18 via each of the auxiliary vacuum feeds 42, 44 and 46. As illustrated, auxiliary vacuum feed 42 provides a vacuum pressure to the first street 14 while vacuum feed 44 provides the vacuum pressure to the second street 16 whereas the vacuum feed 46 to the third street 18. The air cooled condenser (ACC) 10 similarly employs a "normal" or standard vacuum system, generally designated 47, that has a standard vacuum conduit 48 and standard vacuum feeds 50, 52 and 54 that provide vacuum suction to the streets 14, 16 and 18. More specifically, as illustrated in FIG. 1, vacuum feed 50 connects to the first street 14; vacuum feed 52 connects to the second street 16; and vacuum feed 54 connects to the third street 18.

As can be seen FIG. 1, each of the streets has two valves, one for the normal vacuum system 47 and one for the auxiliary vacuum system 41, that manipulate the suction flows for each of the vacuum systems 41, 47 for the respective streets. For example, the respective valves 56 and 58 control the vacuum suction for the first street 14. Valve 56 controls the suction via the connection 66 for the auxiliary vacuum system 41 whereas valve 58 controls the vacuum suction via the connection 68 for the standard vacuum system 47. Turning to the second street 16, valve 59 controls the suction via the connection 70 for the auxiliary vacuum system 41 whereas valve 60 controls the vacuum suction via the connection 72 for the standard vacuum system 47. With respect to the third street 18, valve 62 controls the suction via the connection 74 for the auxiliary vacuum system 41 whereas valve 64 controls the vacuum suction via the connection 76 for the standard vacuum system 47.

Figure 2:
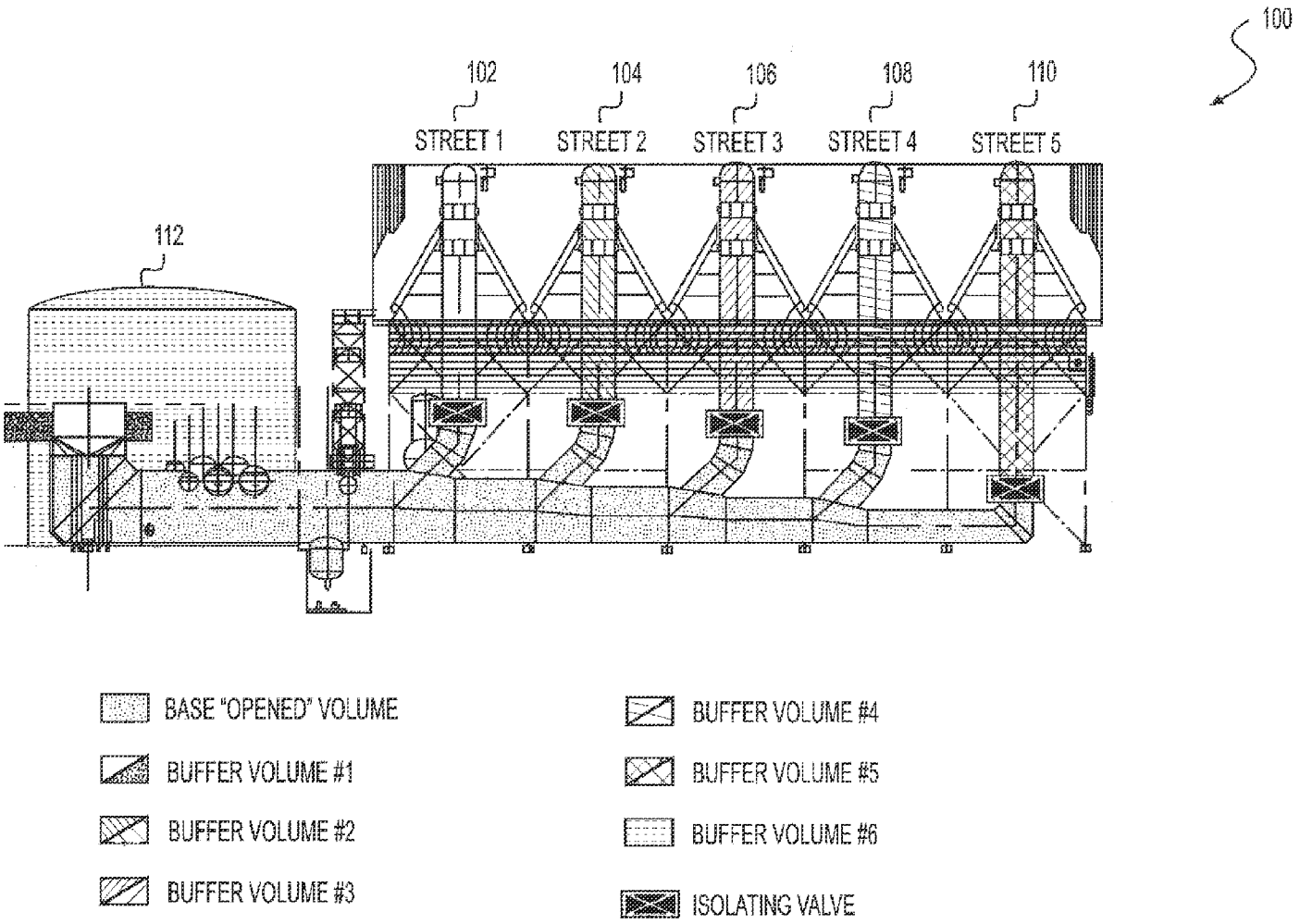
FIG. 2 is a side view of air cooled condenser in accordance with an embodiment of the present invention.
Figure 3:
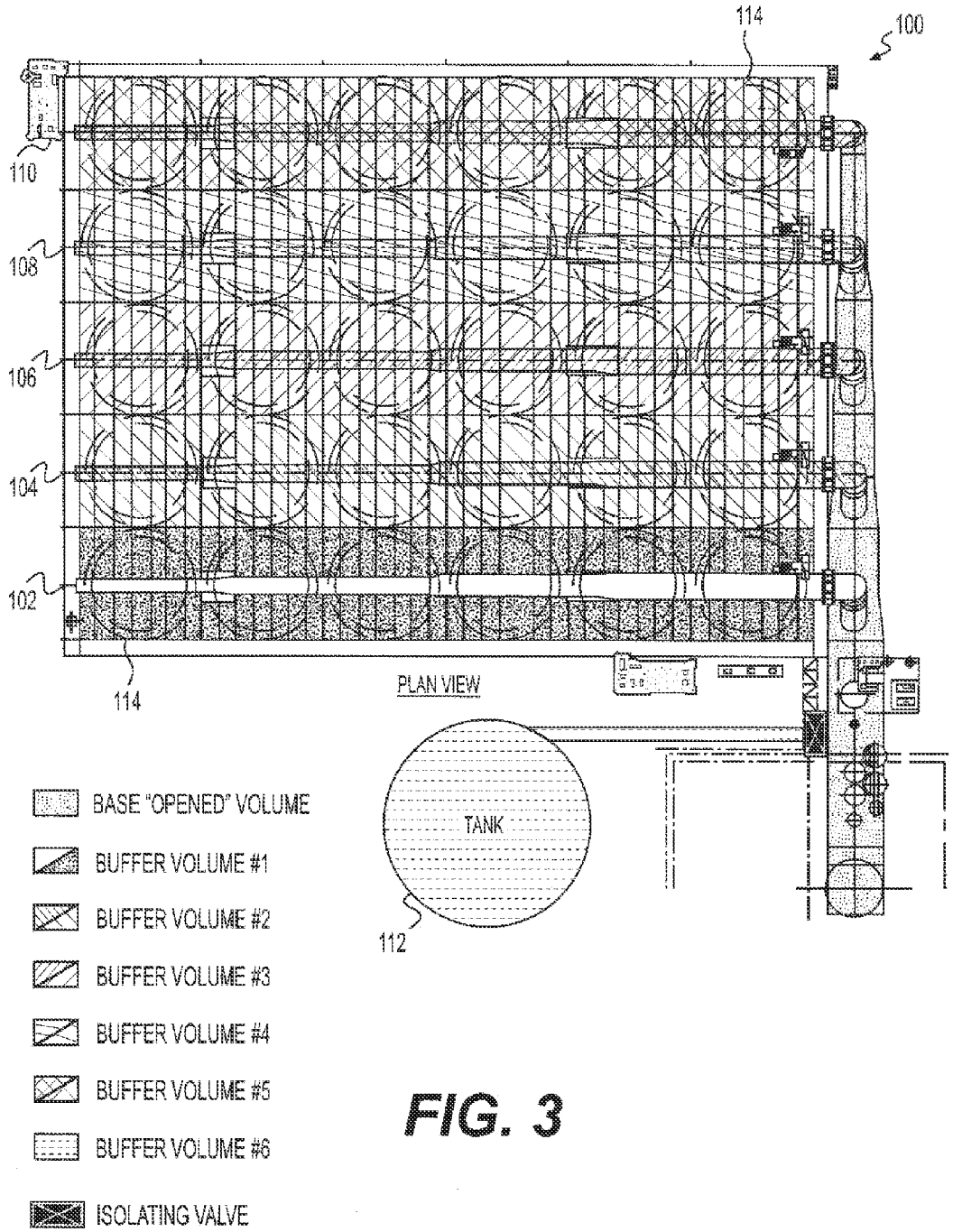
FIG. 3 is a plan view of an air cooled condenser in accordance with an embodiment of the present invention.

Turning now to FIGS. 2 and 3, whereas FIG. 1 depicted an air cooled condenser (ACC) having a total of three streets, FIGS. 2 and 3 illustrate an air cooled condenser (ACC), generally designated 100, employing five streets 102, 104, 106, 108 and 110. While the embodiment 100 illustrated in FIGS. 2 and 3 employs five streets 102, 104, 106, 108, 110, it utilizes features similar to that described in accordance with FIG. 1, including the buffer tank 112.

As previously discussed, the streets 14, 16, 18, 102, 104, 106, 108, 110 house the individual air cooled condenser (ACC) modules 114. The streets 14, 16, 18, 102, 104, 106, 108, 110 can vary size depending upon the number of air cooled condenser (ACC) modules each houses. For example, while the streets 102, 104, 106, 108, 110 illustrated in FIG. 3 each house five modules 114, the number of modules may vary having more or less depending the heat exchange capacity needed.

Referring now to FIGS. 1-3, as previous discussed, cooling towers such as air cooled condensers (ACC) as depicted and described herein, are oftentimes used in conjunction with steam generating systems. While not illustrated in complete detail, the air cooled condenser (ACC) design depicted may be, for example, a tower having a large box-like structure having an open lower frame. The open lower frame may be closed off on two of its sides. The open lower frame supports a deck having a series of fans which blows air upward so that the air is drawn in through the open sides of the tower and is forced upward by the fans. Typically, above the fans the tower supports a series of condenser coils. In some examples, a plurality of steam supply header tubes run lengthwise on the top of the tower and dispense steam downward into angled downwardly extending condenser coils. In some examples, water is heated in a boiler to create steam, which is then sent to a high pressure end of a turbine to create work (via change in energy of the steam). The steam at the low pressure end of the turbine then is condensed by the condenser to create a vacuum that pulls the steam through the turbine. At the bottom of the angled downwardly extending condenser coils is a series of collection header tubes which receives condensed fluid and exits it from the tower. The entirety of the condenser coils is usually located above the fans. Air is exhausted out the open top of the tower past the steam supply header tubes.

Since the condensation coils are warmer compared to the ambient air entering the tower, as the air passes through the coils it tends to be warmed and tends to rise. This creates a natural draft which would draw some air into the sides of the tower below the coils and upward through the coils. However, it has generally been found in some applications that the natural draft created by the coils alone is insufficient to provide a desired operation level. Therefore, in instances a deck of the fans is added below the coils to provide a greater volume of air flow. Alternatively, airflow by natural draft may be promoted by constructing a large shell or stack of sufficient height and width.

Figure 4:
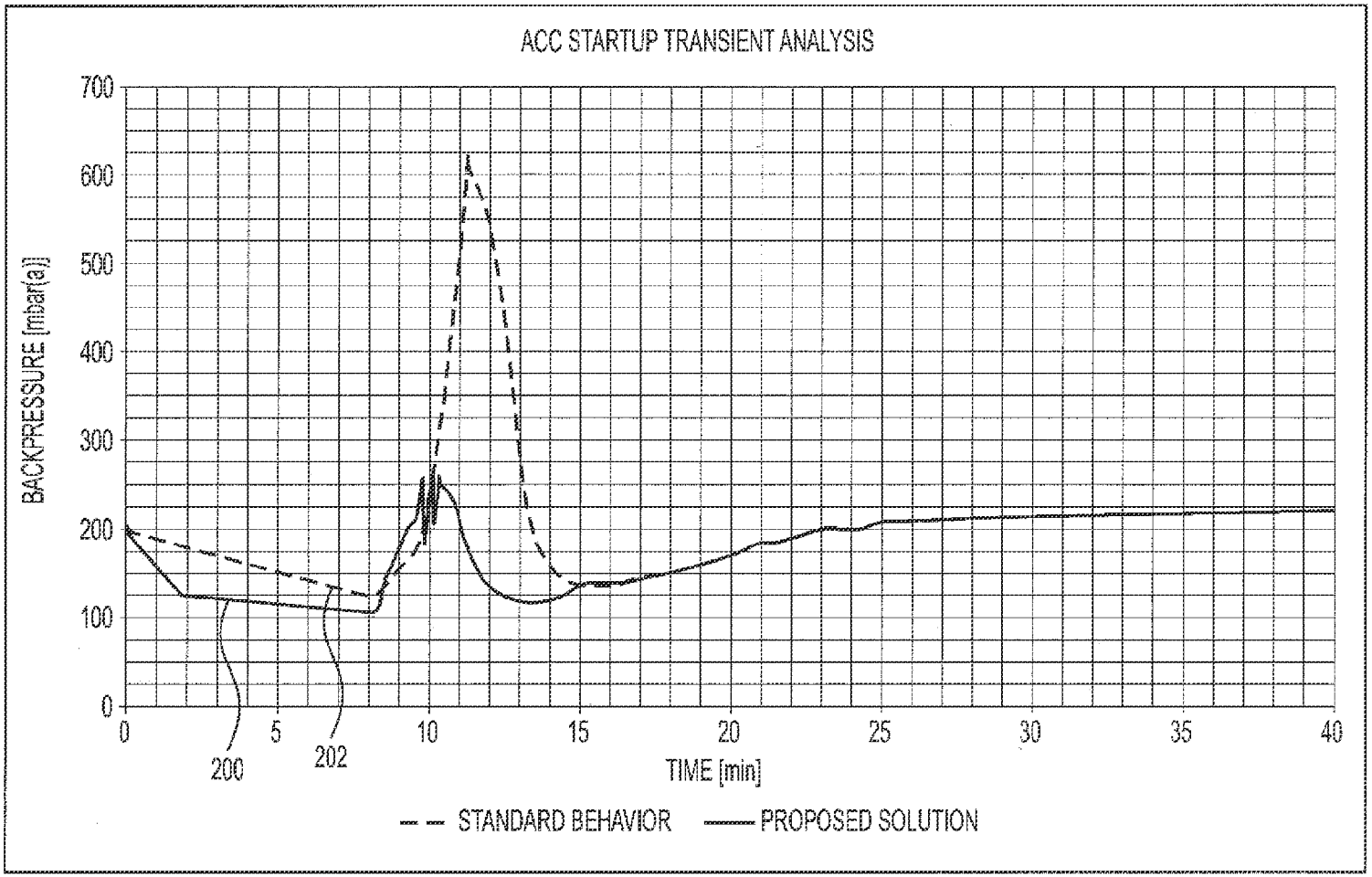
FIG. 4 is a graph depicting the air cooled condenser start-up transient analysis illustrated in FIGS. 1-3 in accordance with an embodiment of the present invention.

Turning now to FIG. 4, a back pressure curve is illustrated showing back pressure of a typical startup procedure compared to the design and start up procedure encompassed by the present discussed herein. One solution encompassed by the present invention, and discussed in more detail below, is to isolate some volumes of the streets that make of the air cooled condenser (ACC) modules.

In one embodiment, it is desirable to have the pressure of the respective condenser modules to be decreased as much as possible, for example, to 50 mbar. Next, the steam stream is introduced into the remaining part of the air cooled condenser (ACC). The control strategy, as further described below is to open a low vacuum volume each time a trigger backpressure is exceeded as referenced in FIG. 4. This will likely result in a decrease of the backpressure in the air cooled condenser (ACC) and therefore will prevent the likelihood of high peaks in backpressure.

As discussed in further detail below, the above-described preferred steps require that sonic of the internal volume of the air cooled condenser (ACC) be at a low pressure before the introduction of steam. This does not however require having the entire air cooled condenser (ACC) system at the low pressure conditions. In some embodiments of the present invention, it is preferable to have sixty-five percent (65%) of the total volume at a low pressure condition and upon opening each street at a designated instance provides lower backpressure peak than having the whole installation at the same low pressure conditions from the beginning. The low vacuum volume can be an external tank such as the buffer tank 20, or one (or several) of the streets as discussed below.

Now referring to FIGS. 1-4, during operation, of the air cooled condenser (ACC) system 10, the steam turbine unit 12 is initially brought online. For description purposes, the embodiment illustrated in FIG. 1 will be referenced in combination with FIG. 4, however, said description is applicable to the embodiments illustrated in FIGS. 2 and 3. However, prior to bringing the steam turbine online, in one embodiment of the present invention, the valves 32, 34 and 36 are activated to isolate all but the first street 14. Accordingly, valve 36 is actuated to the open position while valves 34 and 32 are actuated to the closed position. Next, streets 16 and 18 are brought down in pressure by the standard vacuum system 47. At this point the standard vacuum system is activated for a desired period of time, along with the valves 58, 60 and 64, providing suction pressure to the streets 16 and 18, wherein streets 16 and 18 are brought down in pressure. This suction pressure operates to purge said streets 16 and 18 of non-condensables such as trapped air wherein essentially each street 16 and 18 acts as a vacuum buffer tank. The streets may be purged to any desired pressure as desired, however, in one preferred embodiment fifty (50) milibars is preferable.

Alternatively, if the system employs an auxiliary vacuum system in accordance with an embodiment of the present invention, before the steam plant is started up, valves 32, 34, 36 and 38 are initially in the closed position whereas valves 56, 59, 62 and 39 are in the open position. Valves 58,60 and 64, like valves 32, 34, 36 and 38 are closed prior to bringing the steam plant online. Next, the auxiliary vacuum system is turned on and the entire system is drawn down to the target pressure, for example, 50 milibars absolute pressure. Upon reaching the target pressure, valves 56, 59, 62 and 39 are closed and the auxiliary vacuum system turned off. Next, the standard vacuum system 48 is turned on and valves 58, 60, and 64 opened.

Next, steam is fed either from the turbine 12 and/or via the bypass conduit 22, through conduit 24 and into the first street 14 via the feed line 26 and open flow valve 36. As pressure builds as indicated by line 200 of FIG. 4, it may reach a predetermined pressure threshold as sensed by the pressure probes, e.g., two-hundred fifty (250) milibars, at which time the system controller (not pictured) triggers valve 34 to actuate open, allowing steam to enter the second street 16 via the feed 28.

The second street 16 acts as a buffer in this capacity relieving the pressure peak as referenced in FIG. 4. These steps are then repeated depending upon the number of streets employed and each pressure peak. For example, in the system 10 depicted in FIG. 1, as pressure builds in the second street 16 as indicated by line 200 of FIG. 4, it reaches a predetermined pressure threshold as sensed by the pressure probes, e.g., two-hundred fifty (250) milibars, at which time the system controller triggers valve 32 to actuate open, allowing steam to enter the third street 16 via the feed 30. The third street 18 acts as a buffer in this capacity relieving the pressure peak in the second street 16. As previously mentioned, these steps may be repeated for systems employing additional streets. Without the proposed apparatus and method, the backpressure rises to higher undesirable levels as illustrated by dashed line 202.

It is noted that in alternative embodiments of the present invention, the system 10 may be purged in different combination as desired. For example, all of the streets 14, 16, 18 may be purged by the standard vacuum system 47 prior to start up in accordance with the procedures discussed above, or and desired combination of streets may be purged while others not depending upon demand. Alternatively, the auxiliary vacuum system may be utilized to drawn down the pressure in the streets as discussed above. However unlike the standard vacuum system 47, the auxiliary system may employ a much smaller pump for costs savings and may be connected to a buffer tank 20 via the valve 39. Valve 38 connects the buffer tank to feed line 27 to accept stem flow.

As illustrate in FIG. 1, the auxiliary system is in fluid communication with the respective streets 14, 16, 18 via conduit 40 and feed lines 42, 44 and 46. The auxiliary system 41 operates similar to the standard system as discussed above in its operation to draw down the streets via the pump and the valves 56, 59 and 62, however the auxiliary system may employ a buffer tank 20 to provide supplemental buffering capability.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An air cooled condenser system, comprising:

a first street having at least one air cooled condenser module;

a second street having at least one air cooled condenser module;

a steam inlet conduit comprising a first feed inlet in fluid communication with said first street and a second feed inlet in fluid communication with said second street, wherein said steam inlet conduit provides steam to said first and second streets;

a first flow control valve positioned on said first inlet that controls the flow of steam to said first street;

a second flow control valve positioned on said second inlet that controls the flow of steam to said second street;

a first vacuum system for providing suction pressure to said first and second street, comprising:

a suction conduit connected to a pump;

a first vacuum feed that extends from said suction conduit and is in fluid communication with said first street;

a second vacuum feed that extends from said suction conduit and is in fluid communication with said second street;

a first suction valve connected to said first vacuum feed that controls suction flow to said first street; and a second suction valve connected to said second vacuum feed that controls suction flow to said second street; and a second vacuum system for providing suction pressure to said first and second street.

2. The air cooled condenser according to claim 1, wherein said second vacuum system comprises:

a second suction conduit in connected to a second, auxiliary pump;

a third vacuum feed that extends from said suction conduit and is in fluid communication with said first street;

a fourth vacuum feed that extends from said suction conduit and is in fluid communication with said second street;

a third suction valve connected to said third vacuum feed that controls suction flow to said first street; and a fourth suction valve connected to said fourth vacuum feed that controls suction flow to said second street.

3. The air cooled condenser system according to claim 2, further comprising a buffer tank connected to said second vacuum system.

4. The air cooled condenser system according claim 1, further comprising a third street having at least one air cooled condenser module in fluid communication with said steam inlet via a third inlet.

5. The air cooled condenser system according to claim 4, further comprising a third flow control valve positioned on said third inlet that controls the flow of steam to said third street.

6. An air cooled condenser system, comprising:

a first street having at least one air cooled condenser module;

a second street having at least one air cooled condenser module;

a steam inlet conduit comprising a first feed inlet in fluid communication with said first street and a second feed inlet in fluid communication with said second street, wherein said steam inlet provides steam to said first and second streets;

a first flow control valve positioned on said first inlet that controls the flow of steam to said first street;

a second flow control valve positioned on said second inlet that controls the flow of steam to said second street;

a first vacuum system for providing suction pressure to said first and second street, comprising:

a suction conduit in connected to a pump;

a first vacuum feed that extends from said suction conduit and is in fluid communication with said first street;

a second vacuum feed that extends from said suction conduit and is in fluid communication with said second street;

a first suction valve connected to said first vacuum feed that controls suction flow to said first street;

a second suction valve connected to said second vacuum feed that controls suction flow to said second street;

a second vacuum system for providing suction pressure to said first and second street, comprising:

a second suction conduit in connected to a second, auxiliary pump;

a third vacuum feed that extends from said suction conduit and is in fluid communication with said first street;

a fourth vacuum feed that extends from said suction conduit and is in fluid communication with said second street;

a third suction valve connected to said third vacuum feed that controls suction flow to said first street; and a fourth suction valve connected to said fourth vacuum feed that controls suction flow to said second street.

7. The air cooled condenser system according to claim 6, further comprising a buffer tank connected to said second vacuum system.

8. The air cooled condenser system according claim 6, further comprising a third street having at least one air cooled condenser module in fluid communication with said steam inlet via a third inlet.

9. The air cooled condenser system according to claim 8, further comprising a third flow control valve positioned on said third inlet that controls the flow of steam to said third street.

10. A start up method for an air cooled condenser system comprising:

providing an air cooled condenser comprising:

a first street having at least one air cooled condenser module;

a second street having at least one air cooled condenser module;

a steam inlet conduit comprising a first feed inlet in fluid communication with said first street and a second feed inlet in fluid communication with said second street, wherein said steam inlet provides steam to said first and second streets;

a first flow control valve positioned on said first inlet that controls the flow of steam to said first street;

a second flow control valve positioned on said second inlet that controls the flow of steam to said second street;

a first vacuum system for providing suction pressure to said first and second street, comprising:

a suction conduit in connected to a pump;

a first vacuum feed that extends from said suction conduit and is in fluid communication with said first street;

a second vacuum feed that extends from said suction conduit and is in fluid communication with said second street;

a first suction valve connected to said first vacuum feed that controls suction flow to said first street;

a second suction valve connected to said second vacuum feed that controls suction flow to said second street; and a second vacuum system for providing suction pressure to said first and second street;

actuating the first flow controlled valve to an open position that allows steam to flow to the at least one air cooled condenser disposed in the first street;

actuating the second flow controlled valve to a closed position that prevents steam flow to the at least one air cooled condenser module disposed in the second street;

actuating the first suction valve to a closed position;

actuating the second suction valve to an open position;

applying a suction pressure to the second street to draw down an internal pressure of the second street; and flowing steam through the first street.

11. The method according to claim 10, further comprising actuating said second flow control valve to the open position in response to a pressure indicator from the first street to allow steam flow into the second street.

12. The method according to claim 10, wherein said second vacuum system comprises:

a second suction conduit in connected to a second, auxiliary pump;

a third vacuum feed that extends from said suction conduit and is in fluid communication with said first street;

a fourth vacuum feed that extends from said suction conduit and is in fluid communication with said second street;

a third suction valve connected to said third vacuum feed that controls suction flow to said first street; and a fourth suction valve connected to said fourth vacuum feed that controls suction flow to said second street.

13. The method according to claim 12, further comprising a buffer tank attached to said second vacuum system.

14. A start up method for an air cooled condenser system comprising:

providing an air cooled condenser comprising:

a first street having at least one air cooled condenser module;

a second street having at least one air cooled condenser module;

a steam inlet conduit comprising a first feed inlet in fluid communication with said first street and a second feed inlet in fluid communication with said second street, wherein said steam inlet provides steam to said first and second streets;

a first vacuum system for providing suction pressure to said first and second street;

a second auxiliary vacuum system that provides suction to the first and second streets;

applying a suction pressure to the second street to draw down an internal pressure of the second street using the second auxiliary street only; and flowing steam through the first street.

15. The method according to claim 14, further comprising a buffer tank connected to said second, auxiliary vacuum system.

16. The method according to claim 15, further comprising the step of providing a suction pressure to the buffer tank.

17. The method according to claim 16, further comprising the step of flowing steam through said second street.

18. An air cooled condenser system, comprising:

a first street having at least one air cooled condenser module;

a second street having at least one air cooled condenser module;

a first vacuum system for providing suction pressure to said first and second street; and a second vacuum system for providing suction pressure to said first and second streets.

* * * * *